US011013975B2

(12) United States Patent
Cosgrove

(10) Patent No.: US 11,013,975 B2
(45) Date of Patent: May 25, 2021

(54) ATHLETIC TRAINING AID

(71) Applicant: Michael Cosgrove, Corona, CA (US)

(72) Inventor: Michael Cosgrove, Corona, CA (US)

( * ) Notice: Subject to any disclaimer, the term of this patent is extended or adjusted under 35 U.S.C. 154(b) by 0 days.

(21) Appl. No.: 16/566,725

(22) Filed: Sep. 10, 2019

(65) Prior Publication Data

US 2020/0078650 A1 Mar. 12, 2020

Related U.S. Application Data

(60) Provisional application No. 62/729,612, filed on Sep. 11, 2018.

(51) Int. Cl.
*A63B 69/00* (2006.01)

(52) U.S. Cl.
CPC .. *A63B 69/0059* (2013.01); *A63B 2069/0006* (2013.01)

(58) Field of Classification Search
CPC .. A63B 69/0059; A63B 71/14; A41D 13/088; A61F 5/0118; A61F 5/0104
USPC ... 473/422, 458, 450, 464, 59, 62, 213, 212; 602/14, 21, 22, 64; 2/16, 20, 170
See application file for complete search history.

(56) References Cited

U.S. PATENT DOCUMENTS 1,418,637 A 6/1922 Flood
2,794,638 A 6/1957 Risher et al.
3,497,218 A 2/1970 Johnston
3,606,342 A 9/1971 Albertson, Jr.
3,726,525 A * 4/1973 Jackson ..... A63D 5/00 473/61
3,880,426 A 4/1975 Morse
3,888,482 A 6/1975 Starrett et al.
4,138,108 A * 2/1979 Robinson ..... A63B 71/14 473/62
4,183,098 A * 1/1980 Knowles, Jr. ..... A41D 13/088 473/62
4,558,694 A 12/1985 Barber
RE32,566 E * 12/1987 Patton, Jr. ..... A41D 13/088 473/62
5,207,430 A * 5/1993 Goins ..... A63B 69/0059 473/213
5,415,624 A * 5/1995 Williams ..... A61F 5/0104 602/14
5,499,820 A 3/1996 Albertsson
5,634,854 A 6/1997 Albertsson
5,728,059 A * 3/1998 Wiesemann ..... A61F 5/0118 128/878
5,898,938 A 5/1999 Baylor et al.
5,899,870 A 5/1999 Deirmendjian et al.
6,716,185 B1 4/2004 Rieger
8,702,634 B2 * 4/2014 Crompton ..... A61F 5/0118 602/21

(Continued)

*Primary Examiner* — Mitra Aryanpour
(74) *Attorney, Agent, or Firm* — Knobbe, Martens, Olson & Bear, LLP

(57) ABSTRACT

A training aid for throwing a curveball is disclosed herein. The training aid can include a base member that can coupled to a user's wrist. The training aid can further include a first stiffener and a second stiffener coupled to the base member and extending towards the fingertips of the user. The first stiffener can extend over the top of the user's hand and the second stiffener can extend over the palm of the user's hand. The first stiffener and the second stiffener can maintain the wrist/hand position by preventing the wrist from flexing and extending.

19 Claims, 8 Drawing Sheets

(56) References Cited

U.S. PATENT DOCUMENTS

| | | | | |
|---|---|---|---|---|
| D810,220 | S | 2/2018 | Ahn et al. | |
| 2004/0049141 | A1* | 3/2004 | Slautterback | A61F 5/0118 602/21 |
| 2007/0276303 | A1* | 11/2007 | Jenner, Jr. | A61F 2/586 602/21 |
| 2012/0100938 | A1 | 4/2012 | McKinley | |
| 2012/0310130 | A1* | 12/2012 | Crompton | A61F 5/0118 602/21 |
| 2013/0225336 | A1 | 8/2013 | Harvey | |
| 2014/0221114 | A1 | 8/2014 | Woody | |
| 2015/0285696 | A1 | 10/2015 | Adamski et al. | |

* cited by examiner

ATHLETIC TRAINING AID

INCORPORATION BY REFERENCE TO ANY PRIORITY APPLICATIONS

This application claims the benefit of priority of U.S. Provisional Patent Application No. 62/729,612, filed on Sep. 11, 2018. The above application is incorporated by reference herein and is to be considered a part of this specification. Any and all applications for which a foreign or domestic priority claims is identified in the Application Data Sheet as filed with the present application are hereby incorporated by reference under 37 CFR 1.57.

BACKGROUND

Field of the Disclosure

This disclosure relates generally to the development of a throwing or pitching training device that helps users to maintain a desired wrist/hand position during a wind up, release, and follow-through.

Description of the Related Art

A curveball is different from other types of pitches in few ways. It is typically much slower than a fastball and has, when executed properly, dramatic downward movement. Curveballs have topspin whereas other pitches often have backspin. The topspin gives curveballs late diving action. Curveballs are thrown with the wrist supinated as it passes by a pitcher's head. When supinated, the wrist is turned palm-in towards the body regardless of whether a pitcher is right-handed. A typical grip for a curveball involves a middle finger resting on one of the seams and a thumb resting on a seam opposite from the seam on which the middle finger is placed.

When a curveball is thrown, the thumb rotates upward and the middle finger rotates downward such that the ball rolls off of the middle finger. As the ball rolls off of the middle finger, topspin is generated. The wrist remains supinated during the release. The wrist/hand position can impact the velocity or the topspin of the curveball. For example, flexing the wrist towards the inside or the outside of the forearm during a release can negatively impact the velocity or topspin of the ball. Maintaining proper or desired wrist/hand position can reduce the risk of applying stress or strain to a pitcher's wrist, forearm, elbow, shoulder, or various ligaments and muscles that connect those joints. It is therefore important to have a device that can maintain proper or desired wrist/hand position of a pitcher in order to reduce the risk of injury and maintain velocity of the curveball.

SUMMARY

The embodiments disclosed herein each have several aspects no single one of which is solely responsible for the disclosure's desirable attributes. Without limiting the scope of this disclosure, its more prominent features will now be briefly discussed. After considering this discussion, and particularly after reading the section entitled "Detailed Description," one will understand how the features of the embodiments described herein provide advantages over existing systems, devices and methods for maintaining proper or desired wrist/hand position during a wind up and a release.

The following disclosure describes non-limiting examples of some embodiments. For instance, other embodiments of the disclosed systems and methods may or may not include the features described herein. Moreover, disclosed advantages and benefits can apply only to certain embodiments of the invention and should not be used to limit the disclosure.

According to an aspect, an alignment device for holding a wrist of a user at a desired position by restricting movement of the wrist is disclosed. The alignment device can include a base member including an attachment device. The attachment device can wrap around at least a distal portion of a forearm of a user and removably attach the base member to the forearm. The alignment device can also include a first stiffener coupled to the base member. The first stiffener can extend between a top portion of the base member and a top portion of the user's hand. The first stiffener can restrict movement of the wrist by preventing the wrist from extending about a transverse axis of the wrist. The alignment device can also include a second stiffener coupled to the base member. The second stiffener can extend at least between a bottom portion of the base member and a palm of the hand such that the hand is positioned between the first stiffener and the second stiffener. The second stiffener can restrict movement of the wrist by preventing the wrist from flexing about the transverse axis of the wrist. The second stiffener can include a first curved portion extending from the base member and a base of the palm of the hand, the first curved portion shaped to extend in a direction away from the hand. The second stiffener can also include a second curved portion extending away from the first curved portion towards a middle of the palm. The second curved portion can be shaped to define a space between the second curved portion and the palm, the space allowing the user to flex the hand to grip a ball. At least a portion of the second curved portion can be in contact with the palm of the hand. The second curved portion shaped to extend in a direction towards the hand.

The first curved portion and the second curved portion together can have a shape that corresponds to a proximal portion of the palm adjacent to the wrist. The second stiffener can extend between the wrist and the middle portion of the palm. At least a portion of the second stiffener can extend between a first muscle that allows movement of thumb phalanges of the hand and a second muscle that allows movement of small phalanges of the hand. A width of the second stiffener can vary along a length of the second stiffener. The width of the second stiffener can taper such that a first width of a first end of the second stiffener adjacent to the base member is greater than a second width of a second end of the second stiffener substantially about the middle portion of the palm. The first stiffener can have a first degree of stiffness and the second stiffener has a second degree of stiffness. The first stiffener and the second stiffener can permit ulnar or radial deviation of the wrist about an anteroposterior axis of the wrist. The first stiffener and the second stiffener can restrict ulnar or radial deviation of the wrist about an anteroposterior axis of the wrist.

According to another aspect, an alignment device for holding a wrist of a user at a desired position by restricting movement of the wrist is disclosed. The alignment device can include a base member that can be removably coupled to a forearm of a user. The alignment device can also include a first stiffener extending between a top portion of the base member and a top portion of the user's hand. The first stiffener can prevent the wrist from extending about a transverse axis of the wrist. The alignment device can also include a second stiffener extending at least between a bottom portion of the base member and a palm of the hand such that the hand is positioned between the first stiffener and the second stiffener. The second stiffener can prevent the wrist from flexing about the transverse axis of the wrist. The second stiffener can include a first curved portion extending between the base member and a base of the palm of the hand, the first curved portion curved away from the user's hand. The second stiffener can also include a second curved portion extending between the first curved portion and a middle portion of the palm, the second curved portion curved towards the user's hand.

The first curved portion and the second curved portion can together have a shape that corresponds to a contour of a portion the palm adjacent to the wrist. The second stiffener can extend between the wrist and the middle portion of the palm, and at least a portion of the second stiffener can extend between a first muscle that allows movement of thumb phalanges of the hand and a second muscle that allows movement of small phalanges of the hand. A width of the second stiffener can vary along a length of the second stiffener. The width of the second stiffener can taper such that a first width of a first end of the second stiffener adjacent to the base member is greater than a second width of a second end of the second stiffener substantially about the middle portion of the palm. The first stiffener and the second stiffener can permit ulnar or radial deviation about an anteroposterior axis of the wrist. The anteroposterior axis is orthogonal to the wrist and extends between a top and a bottom of the wrist. The first stiffener can have a first degree of stiffness and the second stiffener can have a second degree of stiffness. The first stiffener and the second stiffener can permit ulnar or radial deviation of the wrist about an anteroposterior axis of the wrist. The first stiffener and the second stiffener can restrict ulnar or radial deviation of the wrist about an anteroposterior axis of the wrist.

According to another aspect, a method of placing a user's wrist in a desired position by restricting movement of the wrist is disclosed. The method can include coupling a base member to a user's forearm. The method can also include placing a first stiffener on a top portion of the user's hand and a top portion of the wrist. The method can also include coupling the first stiffener to the base member, the first stiffener preventing the wrist from extending about a transversal axis of the wrist. The method can also include placing a second stiffener on a bottom portion of the user's hand and a bottom portion of the wrist. The method can also include coupling the second stiffener to the base member, the second stiffener preventing the wrist from flexing about the transversal axis of the wrist, the first stiffener and the second stiffener thereby holding the wrist in a desired position.

The first stiffener and the second stiffener can permit ulnar or radial deviation about an anteroposterior axis of the wrist. The anteroposterior axis can be orthogonal to the wrist and extend between a top and a bottom of the wrist. Placing the second stiffener can include placing the second stiffener on the bottom portion of the hand such that the second stiffener extends between the wrist and the bottom portion of the hand, and positioned between a first muscle that allows movement of thumb phalanges of the hand and a second muscle that allows movement of small phalanges of the hand.

For purposes of summarizing the disclosure, certain aspects, advantages and novel features are discussed herein. It is to be understood that not necessarily all such aspects, advantages or features will be embodied in any particular embodiment of the invention and an artisan would recognize from the disclosure herein a myriad of combinations of such aspects, advantages or features.

Figure 1:
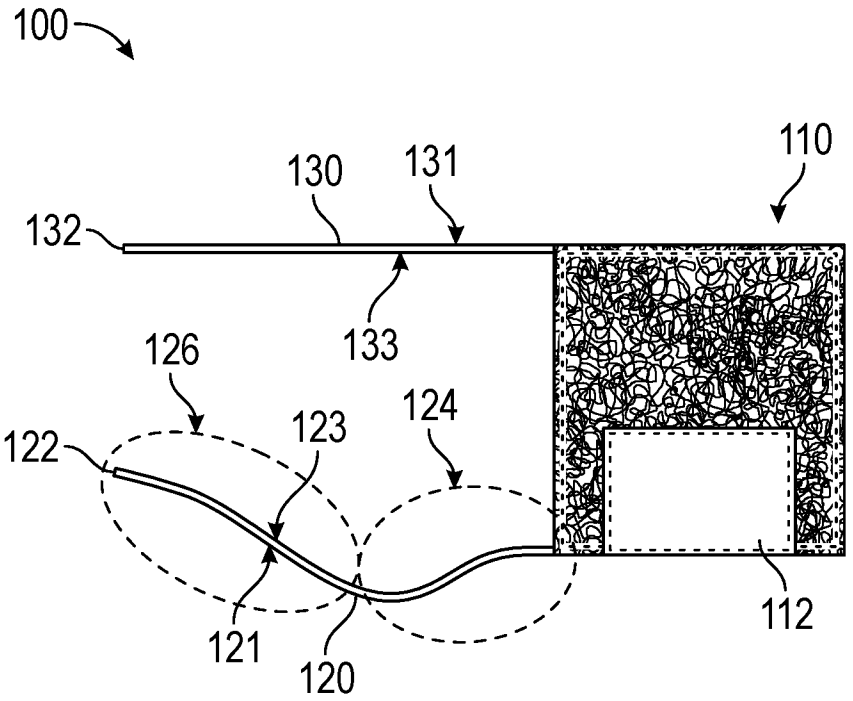
FIG. 1 is a side view of an athletic training aid.

The foregoing and other features of the present development will become more fully apparent from the following description and appended claims, taken in conjunction with the accompanying drawings. Understanding that these drawings depict only several embodiments in accordance with the development and are not to be considered limiting of its scope, the development will be described with additional specificity and detail through use of the accompanying drawings. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present development, as generally described herein, and illustrated in the drawings, can be arranged, substituted, combined, and designed in a wide variety of different configurations, all of which are explicitly contemplated and make part of this disclosure.

DETAILED DESCRIPTION

Curveballs are different from other types of pitches. They are much slower than other types of pitches and have topspin that can cause the ball to drop downwards. Topspin describes a ball rotating forwards as it is moving and is opposite from backspin, which describes a ball rotating backwards as it is moving. As a ball with topspin interacts with the air, the ball pushes the air upwards and the air pushes the ball downwards.

At release, the wrist and the forearm are supinated. In other words, the hand is in palm-in position and the top of the wrist is facing away from the body when the ball is released. Although some pitchers snap their wrist to impart additional topspin to the ball at the release, it is important that the wrist/hand position is maintained at a proper or desired position at the release to reduce the risk of injury.

The stabilizing device disclosed herein inhibits or prevents change in the wrist/hand position during the wind-up and the release by restricting wrist movement. The stabilizing device can include a base member and two stiffening devices that limit the degree of flexion and extension of the wrist during the wind-up and the release.

Figure 2:
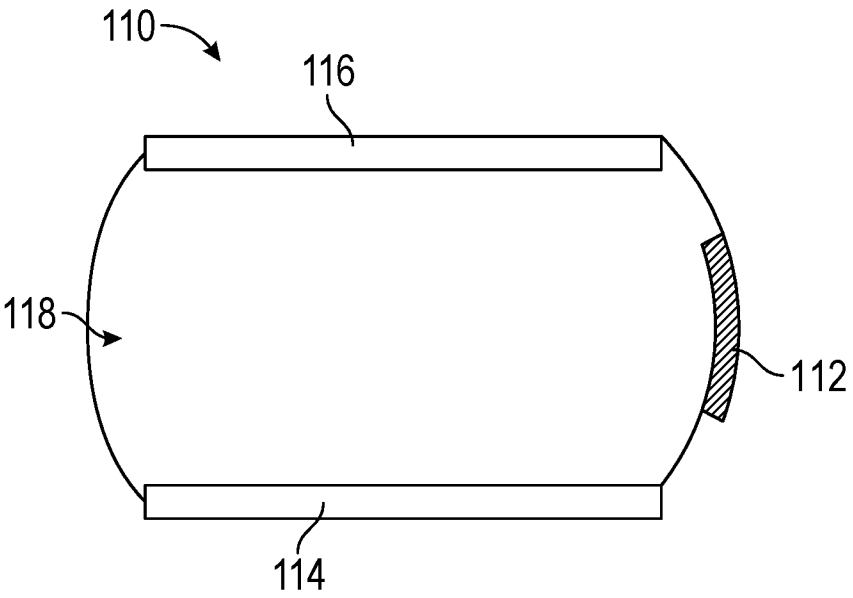
FIG. 2 is a cross-sectional view of a base member of the athletic training aid of FIG. 1.

Referring to FIGS. 1 and 2, the training aid 100 can include a base member 110, a first stiffener 120, and a second stiffener 130. The base member 110 can be a strip of material that can wrap around a wrist and act as a brace. The base member 110 can include an attachment member 112 that may be a strip of fabric material which may be one element of a hook and loop fastener product known commercially as VELCRO or fabric with the VELCRO bonded to it. The trademark VELCRO refers to an article for purposes of fastening comprising a pair of surfaces, one of which is loosely felted providing elements having rounded ends, the two surfaces or material being adapted to securely hold together when pressed against each other, but having the capability that they can be pulled apart so they can unfasten. The surfaces or elements may be called felted or hooked surfaces.

The attachment member 112 can utilize other types of devices including, but not limited to, pins, adhesives, laces, bands, tapes, hooks, buttons, or the like, to removably couple the base member 110 the user's wrist. The attachment member 112 can allow the base member 110 to accommodate wrists of different sizes. The attachment member 112 can be positioned at any location along the base member 110. The base member 110, once removably coupled to the wrist, may be fixed in position such that it does not slide towards the elbow or the hand. The base member 110 can define an opening 118 that is formed between the first pocket 114 and the second pocket 116. The opening 118 can be dimensioned to receive the wrist and the forearm of a user.

The base member 110 can include a first pocket 114 and a second pocket 116. The first pocket 114 can be located on the bottom side of the wrist. The second pocket 116 can be located on the top side of the wrist. The bottom side of the wrist can refer to a portion of the wrist that faces the body when the hand and the wrist are in supinated position. The top side of the wrist can refer to a portion of the wrist that faces away from the body when the hand and the wrist are in supinated position.

The first pocket 114 can be shaped and dimensioned to receive the first stiffener 120. The second pocket 116 can be shaped and dimensioned to receive the second stiffener 130. The first pocket 114 can extend along the body of the base member 110 along a direction substantially parallel to an axis defined by a forearm. Likewise, the second pocket 116 can extend along the body of the base member 110 along a direction substantially parallel to the axis defined by the forearm. The space defined by the first pocket 114 can extend along the length (that is, the direction substantially parallel to the axis defined by the forearm) of the base member 110. The space defined by the second pocket 116 can extend along the length of the base member 110. The shape and the dimensions of the first pocket 114 and the second pocket 116 can be substantially the same.

Figure 3A:
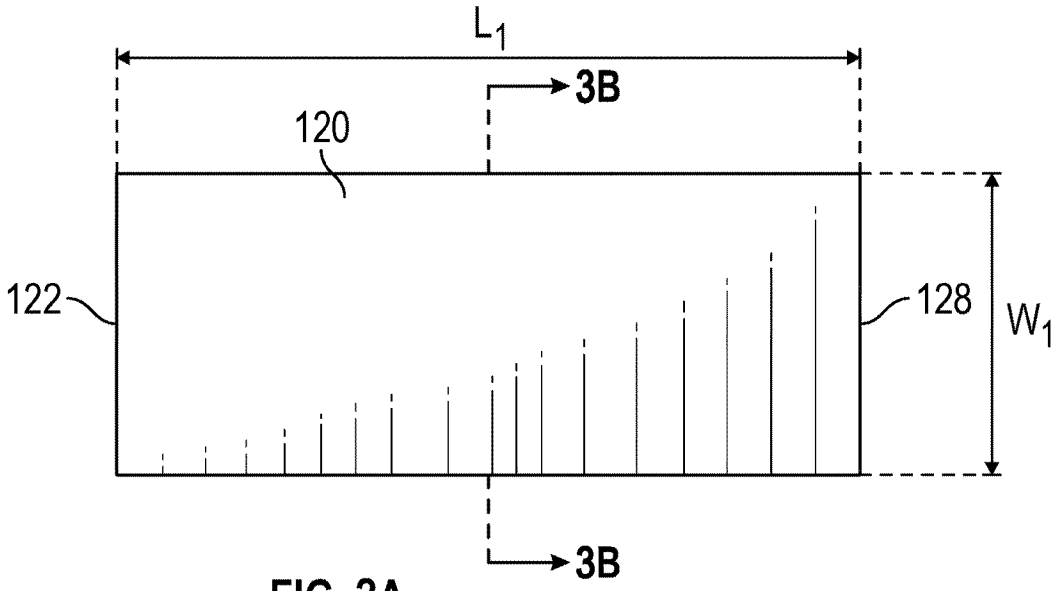
FIG. 3A is a top view of a first stiffener.
Figure 3C:
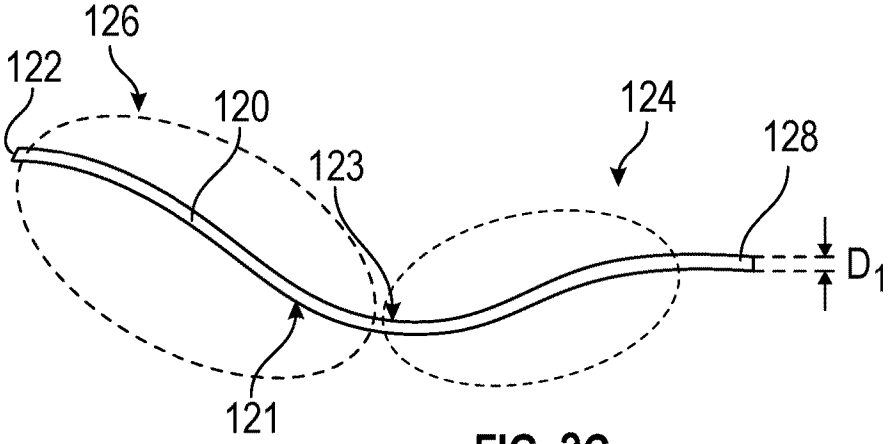
FIG. 3C is a side view of the first stiffener of FIG. 3A.
Figure 3B:
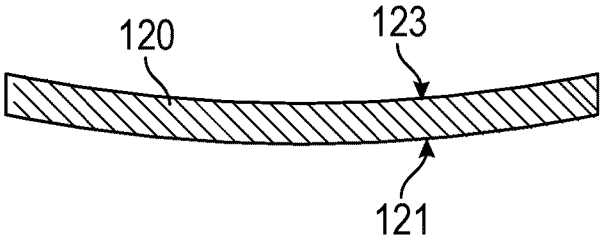
FIG. 3B is a cross-sectional view of the first stiffener of FIG. 3A.
Figure 4A:
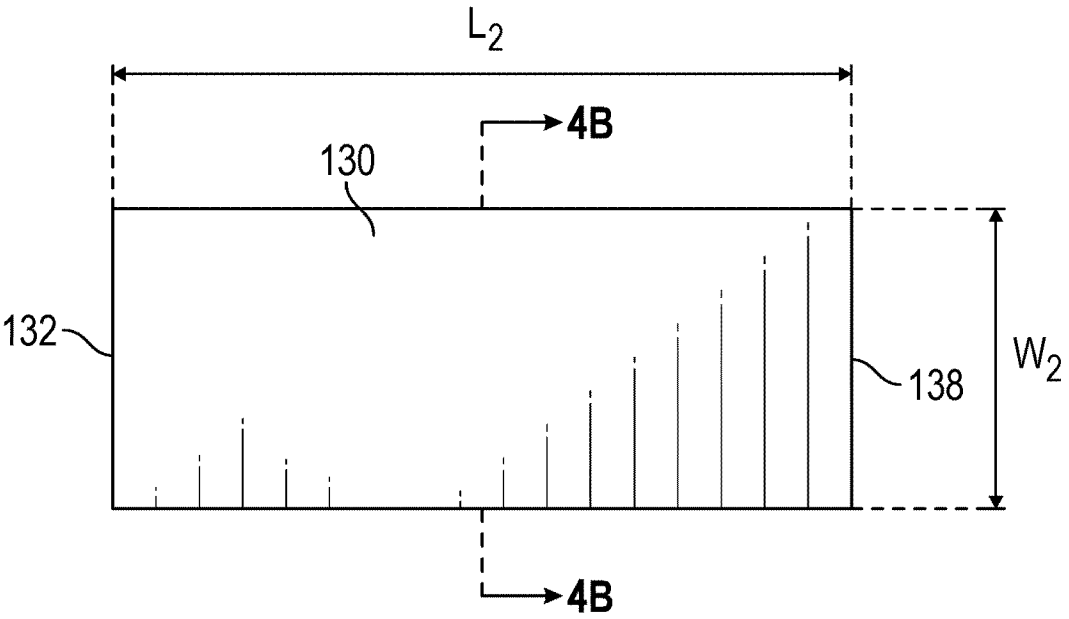
FIG. 4A is a top view of a second stiffener.
Figure 4C:
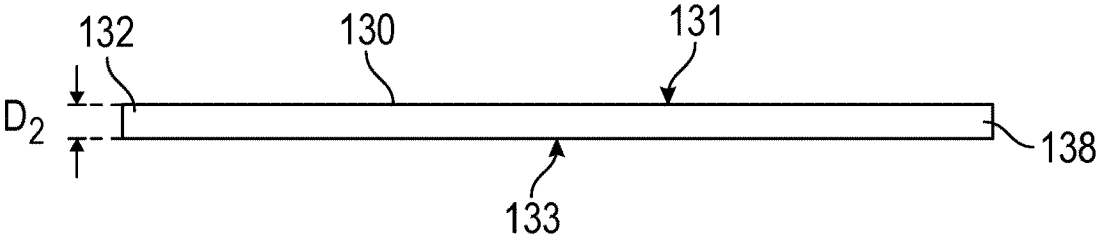
FIG. 4C is a side view of the second stiffener of FIG. 4A.
Figure 4B:
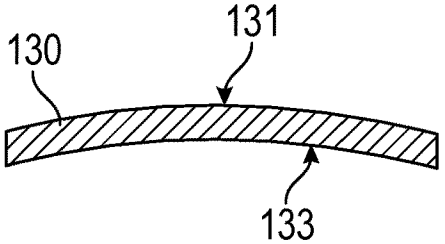
FIG. 4B is a cross-sectional view of the second stiffener of FIG. 4A.

The first pocket 114 can be dimensioned to have a width that is substantially the same as a width $W_1$ (see FIG. 3A) of the first stiffener 120. The second pocket 116 can be dimensioned to have a width that is substantially the same as a width $W_2$ (see FIG. 4A) of the second stiffener 130. The dimensions of the first pocket 114 and the first stiffener 120 can advantageously prevent the first stiffener 120 from being dislodged from the base member 110. Likewise, the dimensions of the second pocket 116 and the second stiffener 130 can advantageously prevent the second stiffener 130 from being dislodged from the base member 110. The first stiffener 120 and the second stiffener 130 can be permanently affixed to the base member 110.

The first stiffener 120 and the second stiffener 130 can extend from the base member 110 in a direction towards the fingertips of the user's hand. The first stiffener 120 and the second stiffener 130 can be positioned such that the user's hand is positioned therebetween. The first stiffener 120 can be coupled to a portion of the base member 110 adjacent to the bottom portion of the wrist. The second stiffener 130 can be coupled to a portion of the base member 110 adjacent to the top portion of the wrist.

The first stiffener 120 can include a distal end 122. The second stiffener 130 can include a distal end 132. The distal ends 122, 132 can be free ends positioned over the top and the palm of the hand, respectively. The first stiffener 120 and the second stiffener 130 may not wrap around the hand, but instead extend over the top and the pam of the hand, respectively. When the training aid 100 is coupled to the wrist, the first stiffener 120 and the second stiffener 130 may be the only portions of the training aid 100 that extend past the wrist. The base member 110 may not provide any support for the hand. As discussed herein, the first stiffener 120 and the second stiffener 130 may not extend so far past the wrist to restrict movements of the fingers. The first stiffener 120 and the second stiffener 130 may not be coupled to each other except via the base member 110.

Referring to FIGS. 3A to 4C, the first stiffener 120 can include a proximal end 128 and a distal end 122. The first stiffener 120 can include a first curved portion 124 and a second curved portion 126 between the proximal end 128 and the distal end 122. The proximal end 128 can be placed within the first pocket 114 such that the first stiffener 120 is removably coupled to the base member 110. The distal end 122 of the first stiffener 120 can be positioned between a distal end and a proximal end of a user's palm. The first stiffener 120 can prevent the wrist from flexing about a transverse axis (that is, a radioulnar axis that extends through the wrist and is substantially parallel to the top and the bottom sides of the wrist).

The distal end 122 of the first stiffener 120 can be positioned about the center of the palm. In some examples, the distal end 122 is positioned at around a bottom third portion of the palm to ensure that the palm area remains free enough to allow a user to hold and throw a ball while using the training aid 100.

The first stiffener 120 can have a thickness $D_1$ that can be between about 0.05 cm and about 0.5 cm, between about 0.1 cm and about 0.45 cm, between about 0.15 cm and about 0.4 cm, between about 0.2 cm and about 0.35 cm, between about 0.25 cm and about 0.3 cm, or about 0.1 cm, about 0.15 cm, about 0.2 cm, about 0.25 cm, about 0.3 cm, about 0.35 cm, about 0.4 cm, about 0.45 cm, about 0.5 cm, or ranges between any two of aforementioned values. The thickness $D_1$ can be greater than 0.5 cm or less than 0.1 cm.

The thickness $D_1$ of the first stiffener 120 can vary between the proximal end 128 and the distal end 122. For example, the thickness of the first curved portion 124 can be greater than that of the second curved portion 126. Since the wrist acts as a pivot for the hand, it may be advantageous for the first curved portion 124 has a thickness that is greater than that of the second curved portion 126. The thickness of the first curved portion 124 may be greater than that of the second curved portion 126. The changes between the thicknesses of the first curved portion 124 and the second curved portion 126 can be gradual.

The first stiffener 120 can have a width $W_1$ that can be between about 2.5 cm and about 7 cm, between about 3 cm and about 6.5 cm, between about 3.5 cm and about 6 cm, between about 4 cm and about 5.5 cm, between about 4.5 cm and about 5 cm, or about 2.5 cm, about 3 cm, about 3.5 cm, about 4 cm, about 4.5 cm, about 5 cm, about 5.5 cm, about 6 cm, about 6.5 cm, about 7 cm, or ranges between any two of aforementioned values. The width $W_1$ can be greater than 7 cm or less than 2.5 cm.

The width $W_1$ of the first stiffener 120 can vary between the proximal end 128 and the distal end 122. For example, the width of the first curved portion 124 can be greater or less than that of the second curved portion 126.

The first stiffener 120 can have a length $L_1$ that can be between about 6 cm and about 15 cm, between about 7 cm and about 14 cm, between about 8 cm and about 13 cm, between about 9 cm and about 12 cm, between about 10 cm and about 11 cm, or about 6 cm, about 7 cm, about 8 cm, about 9 cm, about 10 cm, about 11 cm, about 12 cm, about 13 cm, about 14 cm, about 15 cm, or ranges between any two of aforementioned values. The length $L_1$ can be less than 6 cm or greater than 15 cm. The length $L_1$ of the first stiffener 120 can be such that the first stiffener 120 can provide the user adequate amount of support to prevent flexing of the wrist and yet provide ample amount of space to allow the user to grip a ball without any hindrance from the first stiffener 120. The distal end 122 of the first stiffener 120 may not extend beyond the middle portion of the palm such that the distal end 122 does not negatively impact the range of the forefingers of the hand (that is, the index finger, the middle finger, the ring finger, and the little finger).

The first stiffener 120 can include an inner surface 123 facing the wrist and the palm and an outer surface 121 that faces away from the wrist and the palm. At least a portion of the inner surface 123 of the first stiffener 120 can be in physical contact with the palm or the wrist to prevent the wrist from flexing about its transverse axis. The inner surface 123 and the outer surface 121 can be substantially flat or arcuate in cross-section (see FIG. 4B). Arcuate inner surface 123 can advantageously provide better fit for the training aid 100 at the wrist area. The inner surface 123 can be concave or convex with respect to the outer surface 121. The outer surface 121 can be concave or convex with respect to the inner surface 123.

Different portions of the inner surface 123 and the outer surface 121 can have different cross-sectional curvatures. For example, the inner surface 123 of the first curved portion 124 rests against the proximal portion of the palm and the wrist. Therefore, it may be advantageous for the inner surface 123 of the first curved portion 124 to be concave (with respect to the outer surface 121) such that the inner surface 123 corresponds to the overall curved shape of the proximal portion of the palm and the wrist. On the other hand, the inner surface 123 of the second curved portion 126 rests against the middle portion of the palm. Therefore, it may be advantageous for the inner surface 123 of the second curved portion 126 to be convex (with respect to the outer surface 123) such that the inner surface 123 corresponds to the overall curved shape of the middle portion of the palm.

The first curved portion 124 and the second curved portion 126 can together have a shape that substantially corresponds to a shape of a proximal portion of the palm (that is, a portion proximal and adjacent to the wrist). A distal end of the first curved portion 124 can define a proximal end of the second curved portion 126. The first curved portion 124 can be curved away from the proximal end 128. The second curved portion 126 can be curved away from the first curved portion 124 and into the palm of the hand. In some examples, the second curved portion 126 can be substantially flat.

The first curved portion 124 and the second curved portion 126 may together allow different muscles in the hand to flex and grip a ball. This is advantageous in allowing a user to grip a ball without having the training aid 100 restricting movements of the fingers.

The second stiffener 130 can include a proximal end 138 and a distal end 132. The second stiffener 130 can be substantially flat in contrast to the first stiffener 120. The proximal end 138 can be placed within the second pocket 116 such that the second stiffener 130 is removably coupled to the base member 110. The distal end 132 of the second stiffener 130 can be positioned between the wrist and knuckles of the hand. The second stiffener 130 can prevent the wrist from extending about the transverse axis (that is, a radioulnar axis that extends through the wrist and is substantially parallel to the top and the bottom sides of the wrist).

The second stiffener 130 can have a thickness $D_2$ that can be between about 0.05 cm and about 0.5 cm, between about 0.1 cm and about 0.45 cm, between about 0.15 cm and about 0.4 cm, between about 0.2 cm and about 0.35 cm, between about 0.25 cm and about 0.3 cm, or about 0.1 cm, about 0.15 cm, about 0.2 cm, about 0.25 cm, about 0.3 cm, about 0.35 cm, about 0.4 cm, about 0.45 cm, about 0.5 cm, or ranges between any two of aforementioned values. The thickness $D_1$ can be greater than 0.5 cm or less than 0.1 cm. The thickness $D_2$ of the second stiffener 130 and the thickness $D_1$ of the first stiffener 120 can be the same or different.

The thickness $D_2$ of the second stiffener 130 can vary between the proximal end 138 and the distal end 132. Since the wrist acts as a pivot for the hand, it may be advantageous for a portion of the second stiffener 130 closer to the wrist has a thickness that is greater than that of a portion of the second stiffener 130 further from the wrist. The changes between the thicknesses of the first curved portion 124 and the second curved portion 126 can be gradual.

The second stiffener 130 can have a width $W_2$ that can be between about 2.5 cm and about 7 cm, between about 3 cm and about 6.5 cm, between about 3.5 cm and about 6 cm, between about 4 cm and about 5.5 cm, between about 4.5 cm and about 5 cm, or about 2.5 cm, about 3 cm, about 3.5 cm, about 4 cm, about 4.5 cm, about 5 cm, about 5.5 cm, about 6 cm, about 6.5 cm, about 7 cm, or ranges between any two of aforementioned values. The width $W_2$ can be greater than 7 cm or less than 2.5 cm. The width $W_2$ of the second stiffener 130 and the width $W_1$ of the first stiffener 120 can be the same or different.

The width $W_2$ of the second stiffener 130 can vary between the proximal end 138 and the distal end 132. For example, the width of a distal portion of the second stiffener 130 can be greater or less than that of a proximal portion (that is, a portion that is closer to the wrist than the distal portion) of the second stiffener 130. The change of the width of the second stiffener 130 along its length can be gradual.

The second stiffener 120 can have a length $L_2$ that can be between about 6 cm and about 15 cm, between about 7 cm and about 14 cm, between about 8 cm and about 13 cm, between about 9 cm and about 12 cm, between about 10 cm and about 11 cm, or about 6 cm, about 7 cm, about 8 cm, about 9 cm, about 10 cm, about 11 cm, about 12 cm, about 13 cm, about 14 cm, about 15 cm, or ranges between any two of aforementioned values. The length $L_2$ can be less than 6 cm or greater than 15 cm.

The second stiffener 130 can include an inner surface 133 facing the top of the hand and the wrist and an outer surface 131 that faces away from the top of the hand and the wrist. At least a portion of the inner surface 133 of the second stiffener 130 can be in physical contact with the top of the hand or the wrist to prevent the wrist from extending about its transverse axis. The inner surface 133 and the outer surface 131 can be substantially flat or arcuate in cross-section (see FIG. 3B). Arcuate inner surface 133 can advantageously provide better fit between the second stiffener 130 and the top of the hand and the wrist. The inner surface 133 can be concave or convex with respect to the outer surface 131. The outer surface 131 can be concave or convex with respect to the inner surface 133.

Figure 5A:
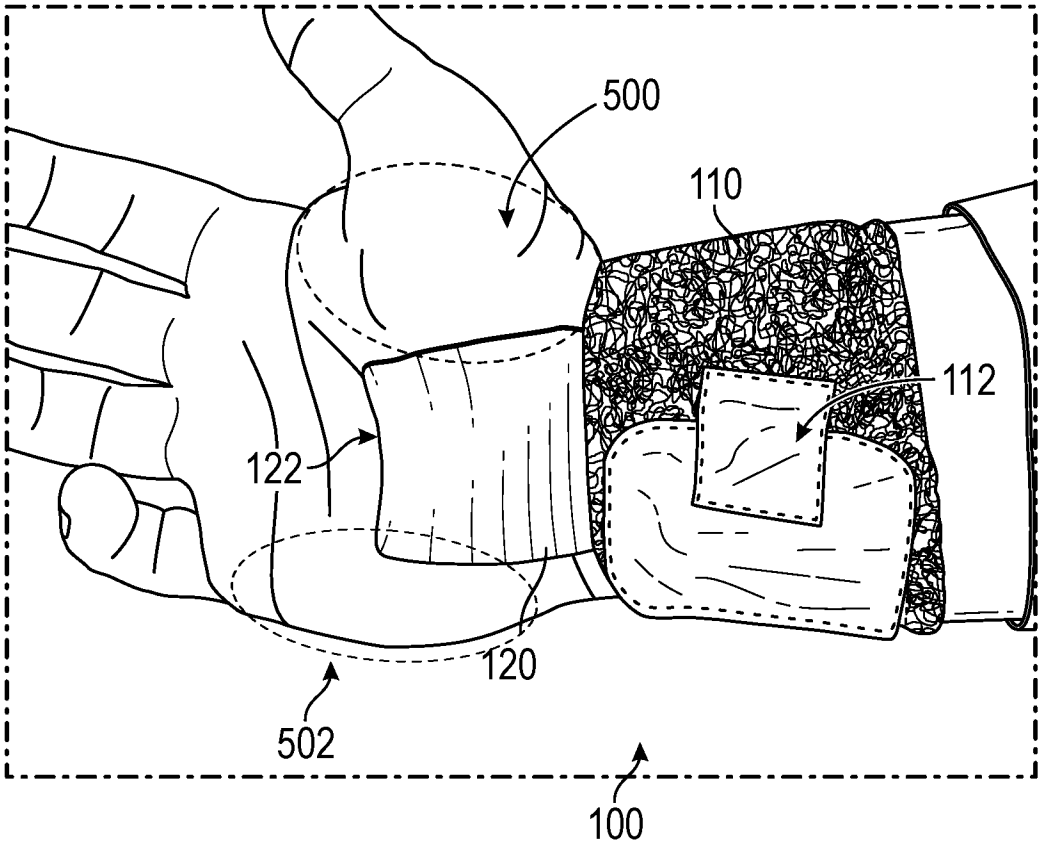
FIGS. 5A-5C are various views of an athletic training aid placed on a user's wrist.
Figure 5B:
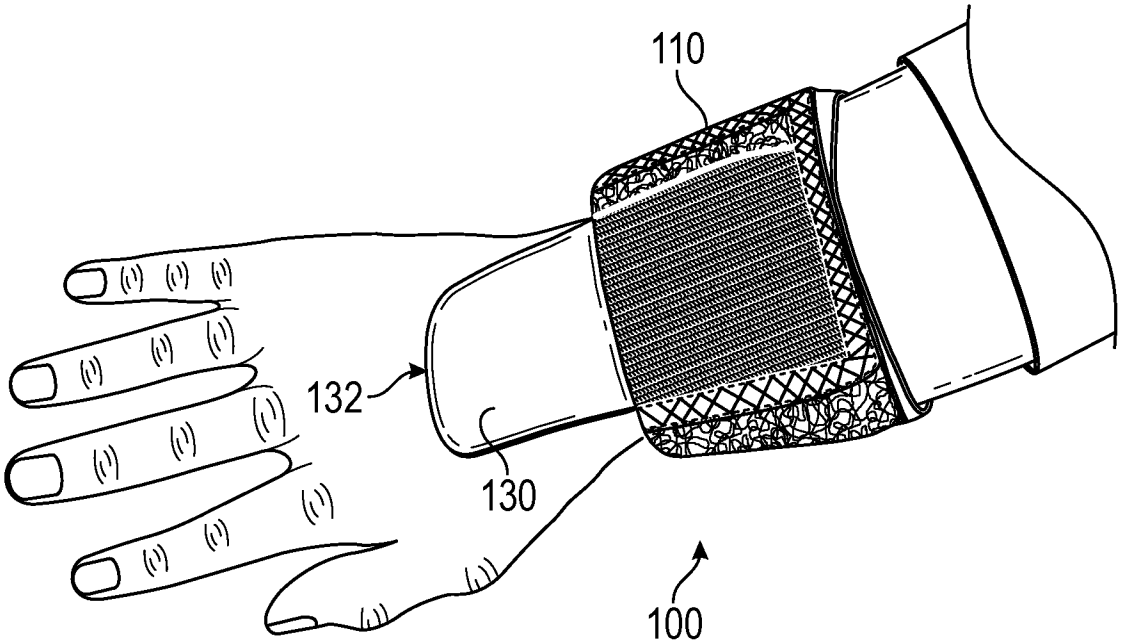
Figure 5C:
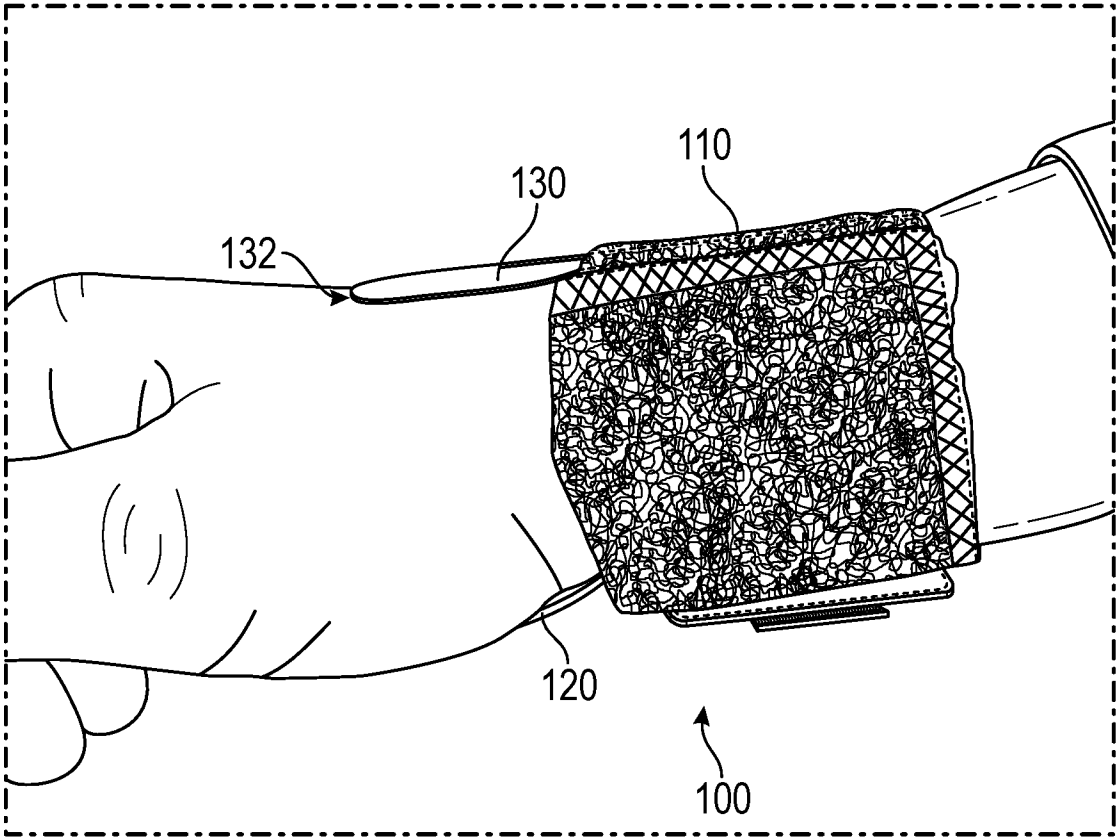

FIGS. 5A-5C show the training aid 100 coupled to a user's wrist and forearm. As discussed herein, the base member 110 can cover a distal portion of the user's forearm and the wrist. As shown in FIGS. 5A-5C, the first stiffener 120 and the second stiffener 130 can extend from the base member 110 towards the fingertips. The first stiffener 120 and the second stiffener 130 can be modular and removably coupled to the base member 110 as discussed herein. In some examples, the first stiffener 120 and the second stiffener 130 can be permanently affixed to the base member 110.

The first stiffener 120 and the second stiffener 130 together maintain a desired wrist/hand position (for example, angular position of the hand with respect to the forearm) during the wind-up, the release, and the follow-through by preventing the wrist from flexing and extending about its transversal axis. As discussed herein, maintaining the proper or desired wrist/hand position (that is, an angular position between an axis defined by the forearm and an axis defined by the palm or the top of the hand) can reduce the risk of injury and improve velocity of the curveball. If the wrist is extended or flexed at the release, such wrist position can generate tension or stress to different ligaments or muscles between the wrist and the elbow. The training aid 100 can maintain a proper or desired wrist/hand position between about 0 degrees and about 60 degrees, between about 5 degrees and about 55 degrees, between about 10 degrees and about 50 degrees, between about 15 degrees and about 45 degrees, between about 20 degrees and about 40 degrees, between about 25 degrees and about 45 degrees, between about 30 degrees and about 40 degrees, or about 0 degrees, about 5 degrees, about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, or any range between two of aforementioned values. In some examples, the first stiffener 120 and the second stiffener 130 maintain the wrist/hand position 0 degrees such that the hand is substantially aligned with the forearm.

In addition to reducing the risk of injury while teaching the user how to throw curveballs, the training aid 100 can also function as a brace that helps the user to maintain the proper or desired wrist/hand position. Such brace can prevent wrist-related injuries such as wrist sprains, muscle strains, tendonitis, wrist inflammation, carpal tunnel syndrome, and the like.

The first stiffener 120 can have a first degree of stiffness and the second stiffener 130 can have a second degree of stiffness. The first degree of stiffness and the second degree of stiffness can be the same or different. Different portions of the first or the second stiffener 120, 130 can have different or the same degree of stiffness. For example, the first curved portion 124 and the second curved portion 126 of the first stiffener 120 can have the same or different level of stiffness. A portion of the first curved portion 124 proximate to the wrist may have a higher degree of stiffness than a portion of the second curved portion 126 proximate to the middle of the palm. This can advantageously allow the first stiffener 120 to inhibit or prevent flexing of the wrist.

The first stiffener 120 and the second stiffener 130 may allow radial and ulnar deviation of the wrist, which describes the wrist pivoting with respect to a sagittal axis that orthogonally extends through the top and the bottom sides of the wrist. In some examples, the first curved portion 124 and the second curved portion 126 can prevent both radial and ulnar deviation of the wrist with respect to the sagittal axis. This can prevent users from "flicking" or "snapping" their wrists at the release point to provide additional topspin to curveballs. Since such "flicking" or "snapping" motion of the wrist can generate stress to various joints (for example, wrist, below, and shoulder) of a throwing arm, preventing radial and ulnar deviation of the wrist can prevent injury.

In some examples, the first stiffener 120 can allow radial deviation of the wrist but inhibit or prevent the ulnar deviation of the wrist. At least a portion of the first stiffener 120 can be positioned such that when a user grips a ball, thenar muscles 500 (see FIG. 5A) of the user's hand contacts and rests against a side of the first stiffener 120. The thenar muscles 500 are found at the base of the thumb and form a muscle bulk on the thumb side of the hand. These muscles allow one to control movement of the thumb. When the thenar muscles 500 bring the thumb towards the small finger (for example, when a user grips a ball), they flex and protrude in a direction away from the palm. When flexed, the thenar muscles 500 can contact the first stiffener. The contact between the thenar muscles 500 and the first stiffener 120 can prevent the ulnar deviation of the wrist during the wind-up, the release, and the follow-through.

The first stiffener 120 can be positioned and dimensioned such that when a user grips a ball, hypothenar muscles 502 (see FIG. 5A) of the user's hand does not come in the way of the first stiffener 120. The first stiffener 120 can be positioned such that it covers at least a portion of the hypothenar muscles 502. Therefore the hypothenar muscles 502 can slide under the first stiffener 120 during radial deviation of the wrist.

The first stiffener 120 and the second stiffener 130 can be made from one or more of materials including, but not limited to, various types of plastic, stainless steel, steel alloys, nickel titanium, molybdenum, copper, copper alloys, ceramic, and the like, to provide sufficient rigidity to maintain wrist/hand position and yet provide sufficient flexibility for comfort. Different parts of the first stiffener 120 and the second stiffener 130 can be made from different materials. For example, the first curved portion 124 of the first stiffener 120 can be made from a material that is more rigid and less flexible and a material used for the second curved portion 126. This can advantageously allow the first stiffener 120 to prevent flexing of the wrist while allowing some flexibility for the second curved portion 126 to provide comfort.

In some examples, the first stiffener 120 and the second stiffener 130 can include materials positioned between the user's hand and the corresponding inner surfaces 121, 131, respectively, to reduce the impact between the hand and the first stiffener 120 and the second stiffener 130.

Figure 6:
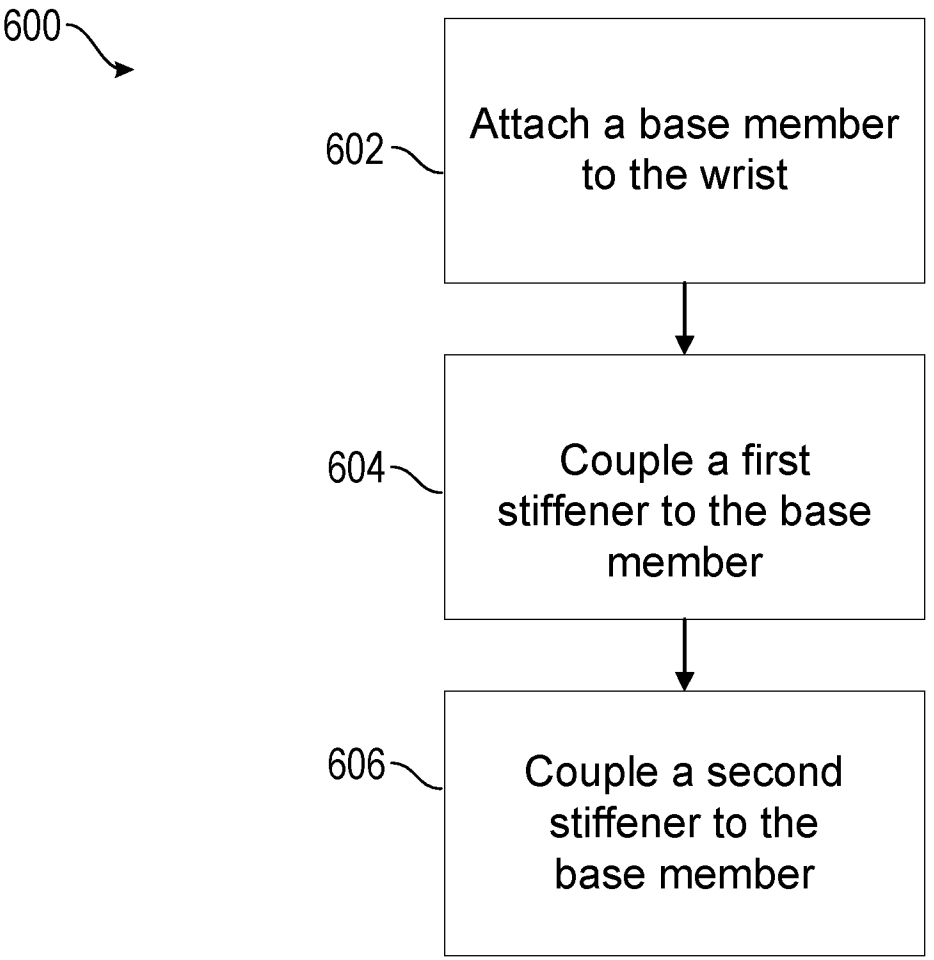
FIG. 6 is flow diagram of an embodiment of a method of coupling an athletic training aid to the wrist.

FIG. 6 is a flow diagram illustrating a method of coupling the training aid 100 to the wrist. At step 602, the base member 110 is coupled to the wrist via methods disclosed herein. At step 604, the first stiffener 120 coupled to the base member 110. As disclosed herein, the first stiffener 120 can be permanently or removably coupled to the base member 110. The first stiffener 120 can extend from the wrist towards the palm of the hand. The first stiffener 120 can include, as disclosed herein, the first curved portion 124 and the second curved portion 126 that has a shape corresponding to the shape of the wrist and a proximal portion of the palm. The first curved portion 124 and the second curved portion 126 can substantially extend along the contour of the wrist, a proximal portion of the palm, and the middle portion of the palm. At step 606, the second stiffener 130 is coupled to the base member 110. The second stiffener 130 can be positioned opposite of the first stiffener 120. The second stiffener 130 can extend from the base member 110 towards the fingertips. The second stiffener 130 can extend along the top of the hand. As disclosed herein, the first stiffener 120 and the second stiffener 130 can prevent flexing and extending of the wrist, thereby preventing injury while learning how to throw curveballs. Additionally, the training aid 100 can function as a brace that can promote healing of wrist or hand-related injuries.

Although this disclosure has been described in the context of certain embodiments and examples, it will be understood by those skilled in the art that the disclosure extends beyond the specifically disclosed embodiments to other alternative embodiments and/or uses and obvious modifications and equivalents thereof. In addition, while several variations of the embodiments of the disclosure have been shown and described in detail, other modifications, which are within the scope of this disclosure, will be readily apparent to those of skill in the art. It is also contemplated that various combinations or sub-combinations of the specific features and aspects of the embodiments may be made and still fall within the scope of the disclosure. For example, features described above in connection with one embodiment may be used with a different embodiment described herein and the combination still fall within the scope of the disclosure. It should be understood that various features and aspects of the disclosed embodiments may be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this invention may comprise, additional to its essential features described herein, one or more features as described herein from each other embodiment of the invention disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations may also be implemented in combination in a single implementation. Conversely, various features that are described in the context of a single implementation may also be implemented in multiple implementations separately or in any suitable subcombination. Moreover, although features may be described above as acting in certain combinations, one or more features from a claimed combination may, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described may be incorporated in the example methods and processes. For example, one or more additional operations may be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems may generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "may," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A wrist alignment device for maintaining a wrist of a user at a desired position while throwing a baseball the wrist alignment device comprising:

a base member comprising an attachment device, the attachment device configured to wrap around a wrist of a user and removably attach the base member to the wrist, wherein when in use, the base member does not extend onto and does not provide support for the user's hand;

a first stiffener coupled to the base member, the first stiffener extending from a top portion of the base member positioned about a top portion of the wrist towards a top portion of the hand, the first stiffener configured to restrict movement of the wrist by preventing the wrist from extending about a transverse axis of the wrist; and a second stiffener coupled to the base member, the second stiffener extending from a bottom portion of the base member positioned about a bottom portion of the wrist towards a palm of the hand such that the hand is positioned between the first stiffener and the second stiffener, the second stiffener configured to restrict movement of the wrist by preventing the wrist from flexing about the transverse axis of the wrist, the second stiffener comprising:

a first curved portion extending from the base member and shaped to extend in a direction away from the palm of the hand; and a second curved portion connected to and extending away from the first curved portion towards a middle of the palm, the second curved portion shaped to define a space between the second curved portion and the palm, the space allowing the user to flex the hand to grip a ball, at least a portion of the second curved portion in contact with the palm of the hand, wherein the first stiffener and the second stiffener are configured to maintain wrist position of the user such that the user's forearm and the top of the hand are aligned.

2. The alignment device of claim 1, wherein the first curved portion and the second curved portion together having a shape that corresponds to a proximal portion of the palm adjacent to the wrist.

3. The alignment device of claim 1, wherein the second stiffener is configured to be positioned between thenar muscles and hypothenar muscles of the hand.

4. The alignment device of claim 1, wherein a width of the second stiffener varies along a length of the second stiffener.

5. The alignment device of claim 4, wherein the width of the second stiffener varies such that a first width of a first end of the second stiffener adjacent to the base member is greater than a second width of a second end of the second stiffener substantially about the middle portion of the palm.

6. The alignment device of claim 1, wherein the first stiffener has a first degree of stiffness and the second stiffener has a second degree of stiffness.

7. The alignment device of claim 1, wherein the second stiffener contacts and rests against thenar muscles of the hand.

8. The alignment device of claim 7, wherein the contact between the second stiffener and the thenar muscles restrict ulnar deviation of the wrist about an anteroposterior axis of the wrist while throwing a baseball.

9. A wrist alignment device for maintaining a wrist of a user at a desired position while throwing a baseball the wrist alignment device comprising:

a base member configured to removably couple to a wrist of a user, wherein when in use, the base member does not extend onto and does not provide support for a user's hand;

a first stiffener extending from a top portion of the base member positioned about a top portion of the wrist towards a top portion of the hand, the first stiffener configured to prevent the wrist from extending about a transverse axis of the wrist; and a second stiffener extending from a bottom portion of the base member positioned about a bottom portion of the wrist towards a palm of the hand such that the hand is positioned between the first stiffener and the second stiffener, the second stiffener configured to prevent the wrist from flexing about the transverse axis of the wrist, the second stiffener comprising:

a first curved portion extending, between the base member and a base of the palm of the hand, the first curved portion curved away from the user's hand; and a second curved portion extending between the first curved portion and a middle portion of the palm, the second curved portion curved towards the user's hand, wherein:

the first stiffener and the second stiffener are configured to maintain wrist position of the user such that the user's forearm and the top of the hand are aligned;

the second stiffener is positioned adjacent to thenar muscles of the hand such that at least a portion of the second stiffener contacts and rests against the thenar muscles, the contact between the second stiffener and the thenar muscles configured to prevent ulnar deviation of the wrist while throwing a baseball.

10. The alignment device of claim 9, wherein the first curved portion and the second curved portion together having a shape that corresponds to a contour of a portion the palm adjacent to the wrist.

11. The alignment device of claim 9, wherein the second stiffener is configured to be positioned between the thenar muscles and hypothenar muscles of the hand.

12. The alignment device of claim 9, Wherein a width of the second stiffener varies along a length of the second stiffener.

13. The alignment device of claim 12, wherein the width of the second stiffener varies such that a first width of a first end of the second stiffener adjacent to the base member is greater than a second width of a second end of the second stiffener substantially about the middle portion of the palm.

14. The alignment device of claim 9, wherein the first stiffener has a first degree of stiffness and the second stiffener has a second degree of stiffness.

15. The alignment device of claim 9, wherein at least another portion of the second stiffener contacts and rests against the hypothenar muscles.

16. The alignment device of claim 15, wherein the contact between the second stiffener and the hypothenar muscles prevent restrict radial deviation of the wrist about an anteroposterior axis of the wrist.

17. A method of placing a user's wrist in a desired position by restricting movement of the wrist while throwing a baseball, the method comprising:

coupling a base member to a wrist, the base member does not extend onto and does not provide support for a user's hand when coupled to the wrist;

coupling a first stiffener to the base member, the first stiffener configured to extend from a top portion of the base member towards a top portion of the hand, the first stiffener configured to prevent the wrist from extending about a transversal axis of the wrist;

coupling a second stiffener to the base member, the second stiffener configured to extend from a bottom portion of the base member towards a palm of the hand, the second stiffener configured to prevent the wrist from flexing about the transversal axis of the wrist, wherein the second stiffener comprises a first curved portion and a second curved portion, the first curved portion extending from the base member and a base of the palm of the hand, the first curved portion curved away from the hand, the second curved portion extending between the first curved portion and a middle portion of the palm, the second curved portion curved towards the hand.

18. The method of claim 17, wherein the first stiffener and the second stiffener permit ulnar or radial deviation about an anteroposterior axis of the wrist, and wherein the anteroposterior axis is orthogonal to the wrist and extends between a top and a bottom of the wrist.

19. The method of claim 17, wherein placing the second stiffener comprises placing the second stiffener on the bottom portion of the hand such that the second stiffener extends between the wrist and the bottom portion of the hand, and positioned between a first muscle that allows movement of thumb phalanges of the hand and a second muscle that allows movement of small phalanges of the hand.

* * * * *